US008177196B1

(12) United States Patent
Bertoli

(10) Patent No.: US 8,177,196 B1
(45) **Date of Patent: *May 15, 2012**

(54) OXYGEN SUPPLY HUMIDIFICATION SYSTEM

(76) Inventor: Charles J. Bertoli, Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/066,544

(22) Filed: Apr. 18, 2011

Related U.S. Application Data

(63) Continuation of application No. 11/655,814, filed on Jan. 18, 2007, now Pat. No. 7,926,791.

(51) Int. Cl.
*B01F 3/04* (2006.01)

(52) U.S. Cl. ..... 261/63; 261/122.1

(58) Field of Classification Search ..... 261/62, 261/63, 64.1, 122.1, 123, DIG. 34, DIG. 38
See application file for complete search history.

(56) References Cited

U.S. PATENT DOCUMENTS 1,103,789 A * 7/1914 Macey ..... 261/122.1
2,133,705 A * 10/1938 Juffa ..... 422/532
2,172,035 A * 9/1939 Roth ..... 141/17
2,587,895 A * 3/1952 Quinn, Jr. et al. ..... 446/20
3,744,771 A * 7/1973 Deaton ..... 261/78.2
4,054,622 A * 10/1977 Lester ..... 261/64.1
4,734,999 A * 4/1988 Fujisawa et al. ..... 34/576
5,101,820 A * 4/1992 Christopher ..... 128/204.18
7,156,380 B2 * 1/2007 Soininen ..... 261/122.1
7,926,791 B1 * 4/2011 Bertoli ..... 261/63
2006/0244160 A1 * 11/2006 Pakdaman ..... 261/122.1

* cited by examiner

*Primary Examiner* — Charles Bushey
(74) *Attorney, Agent, or Firm* — Ramon L. Pizarro; Edwin H. Crabtree

(57) ABSTRACT

An oxygen therapy humidification device is disclosed. The humidification device includes a hollow water reservoir that includes an upper end that has an upper cross-sectional area and a lower end that has a lower cross-sectional area. The lower cross-sectional area is smaller than the upper cross-sectional area. The device also includes an oxygen inlet and an oxygen outlet, both of which are positioned at the upper end of the hollow water reservoir and provide fluid communication to and from the hollow water reservoir. The oxygen inlet includes a bypass valve that is connected to a duct that extends from the oxygen inlet to a diffuser that is positioned at the lower end of the hollow water reservoir. The bypass valve allows the user to control the proportion of water vapor or humidity delivered to oxygen that is passed through the device, with the oxygen entering through the inlet and leaving through the outlet at the desired humidity level.

4 Claims, 5 Drawing Sheets

OXYGEN SUPPLY HUMIDIFICATION SYSTEM

REFERENCE TO RELATED APPLICATIONS

This application is a continuation of my utility application having Ser. No. 11/655,814, filed Jan. 18, 2007, now U.S. Pat. No. 7,926,791, issued Apr. 19, 2011, incorporated herein by reference in its entirety.

BACKGROUND OF THE INVENTION (a) Field of the Invention

This application relates to a system for humidifying oxygen to be supplied through an oxygen therapy device such as the type to be carried by individuals who are required to breathe oxygen-enriched air under medical supervision. More particularly, but not by way of limitation, this application relates to a system that includes a reservoir and a diffuser for enhancing humidification of oxygen being through a water reservoir for humidification.

(b) Discussion of Known Art

The need to humidify gasses being delivered to a patient though breathing devices, such as face masks or tubes that deliver the gas through nasal passages or other passages that lead to a patient's lungs has long been recognized. The humidify these gasses has led to the development of various devices that assist the gas in becoming humidified. As is well known, the ability of a fluid in a gaseous state, such as oxygen or air at room temperature, to accept other gases, such as water vapor, depends on the manner in which the two are exposed. For example, the exposure of a large surface area of water against the gas will provide greater opportunity for the water to evaporate and mix with the adjacent gas. Other factors such as relative humidity will also affect the ability of the gas to accept more water.

A significant problem associated with oxygen therapy is that the oxygen to be administered to the patient is dispensed in a substantially pure form from a cylinder containing the oxygen, a source of oxygen in a liquid state, or from an oxygen concentration system that delivers the oxygen to the patient through a hose that is attached to a breathing mask or a cannula that delivers the gas to the nasal passages. Thus, the oxygen is rather dry, meaning free or substantially free of any moisture. This dryness leads to the drying out of the patient's nasal passages, which eventually leads to chapped nasal tissue and bleeding through cracking of the chapped tissue.

While it is known that the gas being delivered to the patient may be humidified through one of many known devices. However, known devices suffer from a lack of efficiency due to the fact that they typically expose the oxygen by simply placing the end of a tube or pipe in a water bath. This approach provides very little control over the size of the bubbles being delivered from the end of the tube, and thus provides little control over the amount of humidification of the oxygen or gas being delivered to the patient.

Other known devices attach a diffuser at the end of the tube. These diffusers are typically simply mesh or slotted membranes that help break up the bubbles being delivered into the water. Once the bubbles are dispersed into the water, they simply float up to the surface where they break up into slightly humidified oxygen. A significant limitation to this approach is that the diffuser must be kept immersed in water, and thus a significant amount of water must be kept in the humidifier in order to ensure proper function of the diffuser. The amount of water that must be kept in the water reservoir of the humidifier is an important consideration when a person undergoing oxygen therapy carries the device, which includes the weight of the water. More water means more weight to carry around. Accordingly, there remains a need for a humidification system that provides for effective humidification even with very small amounts of water.

Still further, an important feature of a humidification device is the control of the amount of humidification delivered with the oxygen or gas. Many known devices simply provide a fixed, predetermined, amount of humidification, and do not allow for the patient to control the amount of humidification achieved by the device.

Accordingly, there remains a need for an efficient humidification system that can be used with oxygen therapy systems, and which maximizes the use of the water used for humidification.

Therefore, a review of known devices reveals that there remains a need for a simple humidification device that can be attached to a portable oxygen bottle, liquid oxygen supply, or other oxygen supply mechanism that is suspended by a sling from the patient's body.

There remains a need for an efficient humidification system that can be used as a portable device as well as with stationary oxygen delivery devices, such as home oxygen delivery systems or oxygen concentrators or other stationary devices.

There remains a need for a simple humidification device that minimizes the weight of the water being carried, while maximizing the exposure of water to the oxygen being delivered.

Still further, there remains a need for an oxygen humidification system that tolerates tilting of the device at various angles with minimal effect on the device's ability to expose the oxygen to the water held by the humidifier, as well as minimizing the amount of water needed to achieve a desired level of humidification.

SUMMARY

It has been discovered that the problems left unanswered by known art can be solved with the disclosed oxygen therapy humidification device, which includes:

a hollow water reservoir that includes an upper end that has an upper cross-sectional area and a lower end having a lower cross-sectional area, the lower cross-sectional area being smaller than the upper cross-sectional area;

an oxygen inlet and an oxygen outlet positioned at the upper end of the hollow water reservoir and providing fluid communication into the hollow water reservoir, the oxygen inlet having a bypass valve that is connected to a duct that extends from the oxygen inlet to a diffuser that is positioned at the lower end of the hollow water reservoir, the bypass valve allowing the user to control the proportion of water vapor or humidity delivered. The disclosed system uses the bypass valve to divide the oxygen dose into a flow delivered to the duct and to the diffuser or into a flow delivered into the hollow reservoir where it is allowed to remix with oxygen that was delivered to the diffuser, so that the remixed oxygen is then allowed to escape the hollow reservoir through the oxygen outlet providing the user with the prescribed amount of oxygen which has been humidified as desired by the user.

According to a preferred embodiment of the invention, the hollow water reservoir will include sidewalls that gradually taper from the upper cross sectional area to the lower cross sectional area. Still further, it is further contemplated that the hollow water reservoir may include spiral projections that extend into the hollow water reservoir. The spiral projections may be simply molded into the hollow water reservoir, and force oxygen bubbles formed through the diffuser to follow the projections on their way up through the water in the hollow water reservoir, and thus causing the bubbles to remain in contact with the water for a longer period of time, allowing a greater amount of moisture to mix with the oxygen.

The reduction in the cross sectional areas, from a larger upper cross sectional area to a smaller lower cross sectional area, allows water in the hollow water reservoir to be funneled down to where the diffuser is positioned, and held up against the diffuser. This arrangement allows the diffuser to be completely immersed in water while using a very small amount of water. As explained above, the ability to maintain the device's effectiveness with a very small volume of water results in a very lightweight system that can be easily carried by very frail patients.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
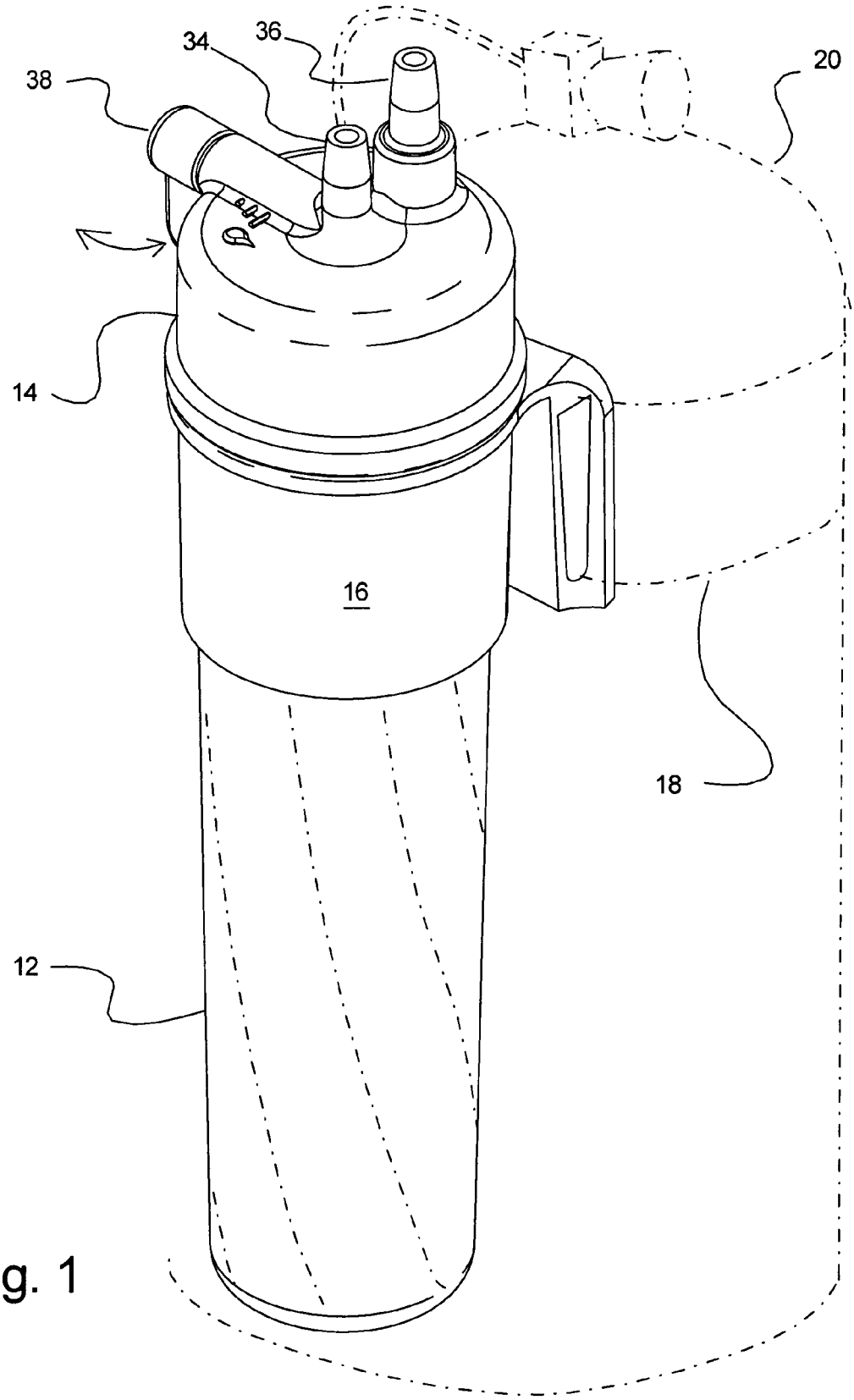
FIG. 1 is a perspective view of a preferred embodiment of the invention.

Turning now to FIG. 1 where a preferred example of a perspective view of an oxygen therapy humidification device 10 that includes inventive structure taught here is illustrated, it will be understood that a preferred example of the oxygen therapy humidification device 10 is designed such that it may be carried by a patient, but as will be discussed below it is also contemplated that it may be used in conjunction with stationary devices, such as fixed oxygen therapy systems that are found in hospitals, assisted living facilities, homes etcetera.

FIG. 1 illustrates that the preferred example of the oxygen therapy humidification device 10 includes a hollow water reservoir 12, a cap 14, and a sleeve 16. The sleeve 16 is adapted for use with a strap 18, which is further illustrated in FIGS. 7 and 8, that can be adjusted to allow mounting of the oxygen therapy device from an oxygen tank 20, an oxygen metering or delivery device.

Figure 2:
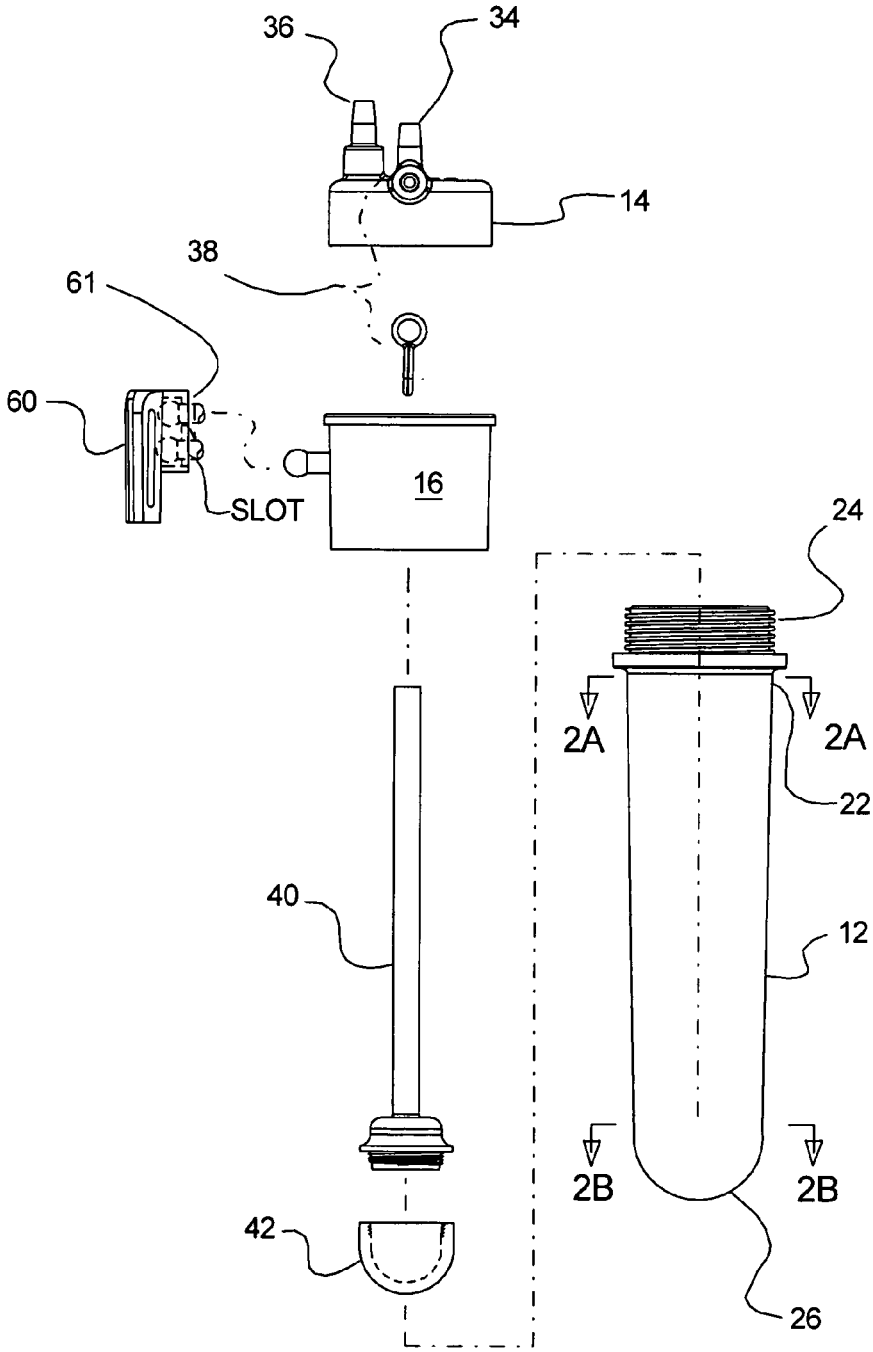
FIG. 2 is an exploded view of the example shown in FIG. 1.
Figure 2A:
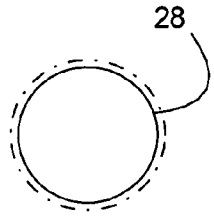
FIG. 2A is a section view taken along line 2A-2A of FIG. 2.
Figure 2B:
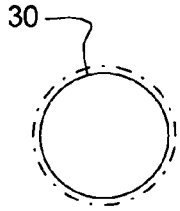
FIG. 2B is a section view taken along line 2B-2B of FIG. 2.
Figure 3:
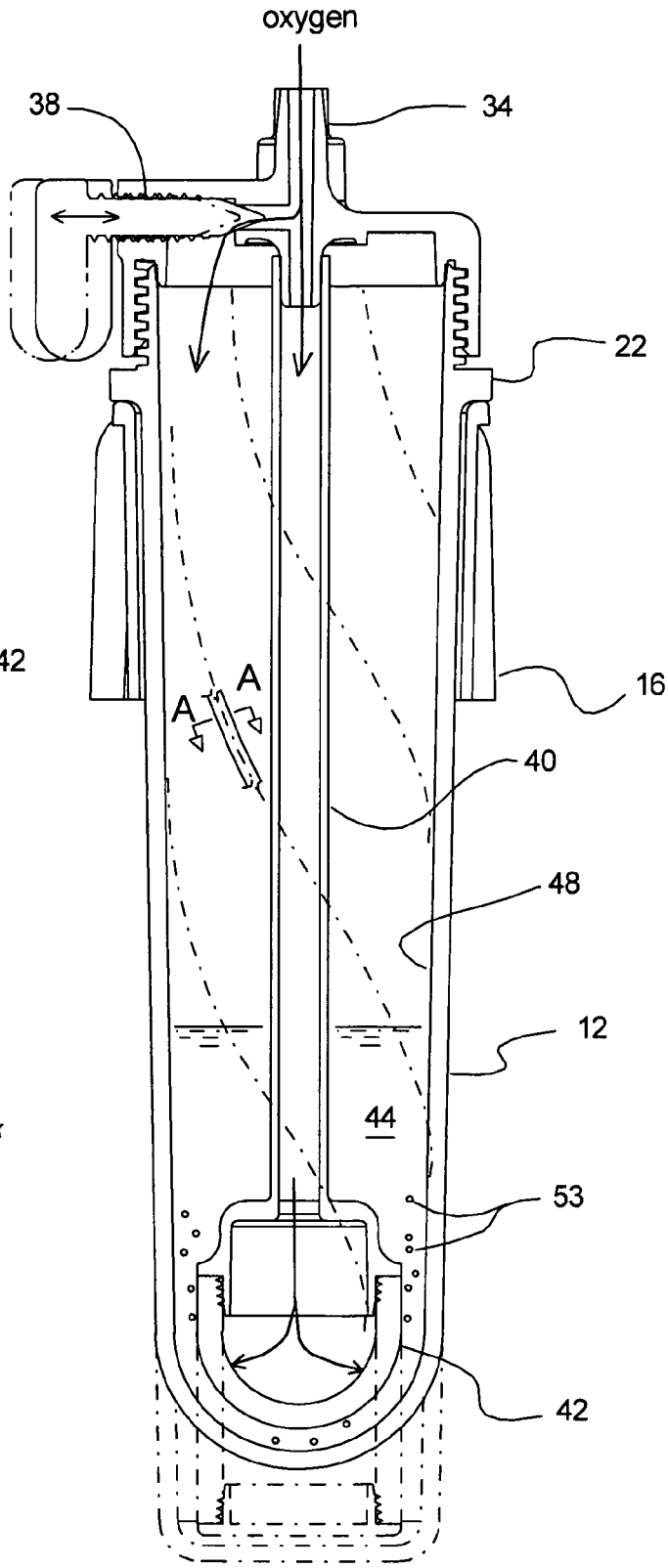
FIG. 3 is a side view of an example that uses spiraled ridges in the hollow water reservoir.
Figure 5:
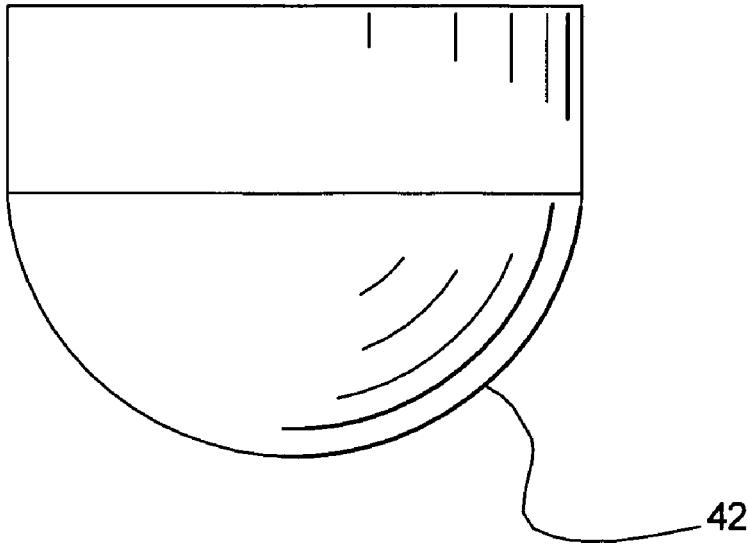
FIG. 5 is a side view of a preferred example of a diffuser for use with the disclosed invention.
Figure 6:
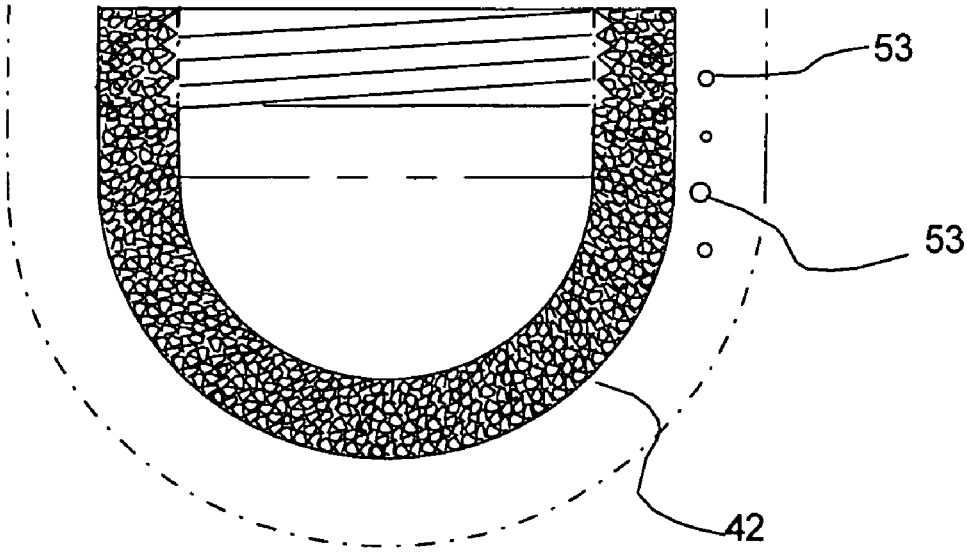
FIG. 6 is a sectional view of the diffuser illustrated in FIG. 5.

Referring to FIGS. 1-3 it will be understood that it is further contemplated that the hollow water reservoir 12 used with the invention preferably includes an upper end 22 that includes a mouth 24. The hollow water reservoir will also include a bottom end 26. These figures also show that the upper end 22 will be of an upper cross-sectional area 28 and the bottom end 26 will include a lower cross-sectional area 30. The lower cross- sectional area 30 is smaller than the upper cross-sectional area 28.

Onto the upper end 22 of the hollow water reservoir 12 attaches the cap 14 that seals off the mouth 24 of the hollow water reservoir 12. The cap 14 includes an oxygen inlet 34 and an oxygen outlet 36 that provide fluid communication into the hollow water reservoir 12. The oxygen inlet 34 will be adapted for connection to an oxygen source, such as an oxygen tank 20 or oxygen separation device. The oxygen outlet 36 will be adapted for connection to an oxygen mask, cannula, or other breathing apparatus.

Turning to FIG. 3, it will be understood that a bypass valve 38 will be positioned between the oxygen inlet 34 and the oxygen outlet 36 of the cap 14. The bypass valve 38 allows the user to control the humidity of the oxygen delivered through the oxygen therapy humidification device 10.

In operation, the bypass valve 38 controls the pressure of the oxygen being delivered through a duct 40 that extends into the hollow water reservoir 12 and is connected to a diffuser 42. Oxygen that is not to be delivered to the diffuser 42 is diverted into the hollow water reservoir 12 by the bypass valve 38. Accordingly, a prescribed constant flow of oxygen from an oxygen supply source can enter the hollow water reservoir through one of two routes. One route is through the diffuser 42, and the other is through diversion from the bypass valve 38. Thus the portion of the oxygen routed through the diffuser will be delivered into a water bath 44 in the hollow water reservoir 12, where it will pick up humidity. The portion of the oxygen that has been delivered into the hollow water reservoir 12 by the bypass valve 38, without going through the diffuser, will be allowed to remix with oxygen that was delivered to the diffuser 42, thus blending humidified portion oxygen from the diffuser with a dry portion of the oxygen prescription that bypassed the diffuser 42 in the hollow water reservoir.

The mixing of oxygen delivered through the bypass valve directly into the hollow water reservoir 12 and the oxygen delivered through the diffuser 42 and through water 46 in the reservoir will allow the user to adjust the moisture being delivered by the oxygen therapy humidification device 10 to the user or patient.

Figure 4C:
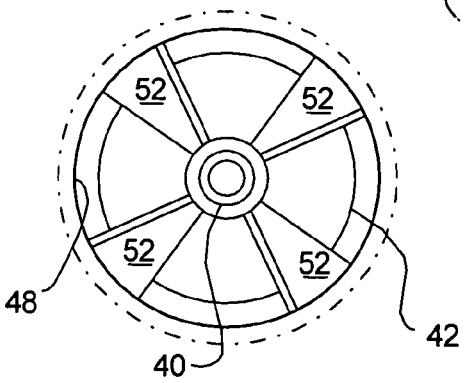
FIG. 4C is a view looking down the duct 40 towards the diffuser 42, and illustrates an alternative arrangement for obstructions for increasing the water exposure time of bubbles created by the diffuser.
Figure 4B:
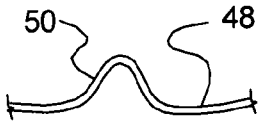
FIG. 4B is a section view taken along line A-A of FIG. 3, and illustrating another example of spiral ridges in the hollow water reservoir.
Figure 4A:
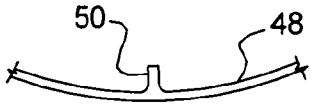
FIG. 4A is a section view taken along line A-A of FIG. 3, and illustrating one example of spiral ridges in the hollow water reservoir.

Turning now to FIGS. 3, 4A and 4B, it will be understood that a highly preferred embodiment of the invention includes the hollow water reservoir 12 with sidewalls 48 with at least one projection 50 that extends into the hollow water reservoir 12. The projection or projections 50 will preferably provide a generally spiraling obstruction between the diffuser 42 and the upper end 22 of the hollow water reservoir 12. The obstruction function of the projections 50 is designed to prevent the oxygen bubbles delivered by the diffuser 42 from taking a direct route to the surface of the water in the oxygen therapy humidification device 10. There are three key variables that affect the ability to humidify a gas, these are: temperature, surface area and exposure time. Accordingly, the projections 50 will force the bubbles to take a longer route to the surface, and thus increase the residence time of the bubbles under the water: the longer the residence time, the more of the oxygen that goes into solution. The rising bubbles will be restrained by the projections 50 and thus forced to follow the spiral up to the surface, thus increasing the residence time of the bubbles in the water, increasing the effectiveness in humidification of the gas bubbles (which in the preferred example is oxygen) of a given amount of water.

As illustrated in FIGS. 4A and 4B, it is preferred that the projection or projections 50 will be of unitary one-piece construction with the sidewalls 48 of the hollow water reservoir 12. However, it is also contemplated that a stationary insert with projections or fins may be position within the hollow water reservoir 12 in order to achieve the purpose of longer residence time of the bubbles in the water. An example of such a mechanism is illustrated in FIG. 4C, which includes a set of helical blades 52 mounted from the duct 40. It is contemplated that such helical blades may be supported from the sides of the hollow water reservoir 12 by mounting them in a radial manner from a ring that is press-fit into the hollow water reservoir 12. However, the illustrated examples reduce the number of parts needed to achieve the increase in residence time of the oxygen bubbles.

Referring now to FIGS. 3-6 it will be understood that the bubbles of oxygen 53, or other gas being humidified with the disclosed invention, will be created through the diffuser 42. The drawings illustrate that it is preferred that the diffuser have a generally spherical shape, and thus providing greatest amount of surface area per given amount of material used to manufacture the diffuser 42. It is contemplated that the diffuser will be made from a porous plastic of the type disclosed in U.S. Pat. No. 6,399,188 to Smith et al., incorporated herein in its entirety by reference, and which is owned by the Porex Corporation of Fairburn, Ga. While it is contemplated that other porous materials may be used, such as compressed fiber elements, rubber membranes with slits or small apertures, or other materials such as porous ceramics, the resistance of the porous plastic, coupled with the ease and precision of manufacture has led to the conclusion that this material is currently preferred for the manufacture of the diffuser 42.

As illustrated in FIGS. 2 and 3, the diffuser 42 will reside within the bottom end 25 of the hollow water reservoir 12. The drawings illustrate that it is contemplated that the inner surface of the hollow water reservoir 12 will be slightly offset from the generally spherical surface 54 of diffuser 42. Thus, the outer diameter of the spherical surface of the diffuser 42 at the bottom end 25 and is about the same size or diameter as the lower cross sectional area 30 of the bottom end 25 of the hollow water reservoir 12. The shape hollow water reservoir 12 will follow the diffuser 42, resulting in the spherical bottom 56, illustrated in FIGS. 2 and 3.

FIGS. 2 and 3 also illustrate that it is preferred that the hollow water reservoir 12 will include a gradual taper from the upper cross sectional area 28 to the lower cross sectional area 30. This gradual reduction is included to create a funneling effect, and thus concentrating water around the diffuser 42. Accordingly, the design will cause the wetting of the entire diffuser 42 with very small amounts of water in the hollow water reservoir 12. As illustrated in FIG. 3, it is contemplated that a generally cylindrical diffuser may be used, but such a design would not achieve the greater wetting of the surface of the diffuser with a small amount of water on a diffuser made from the same amount of diffuser material.

Figure 7:
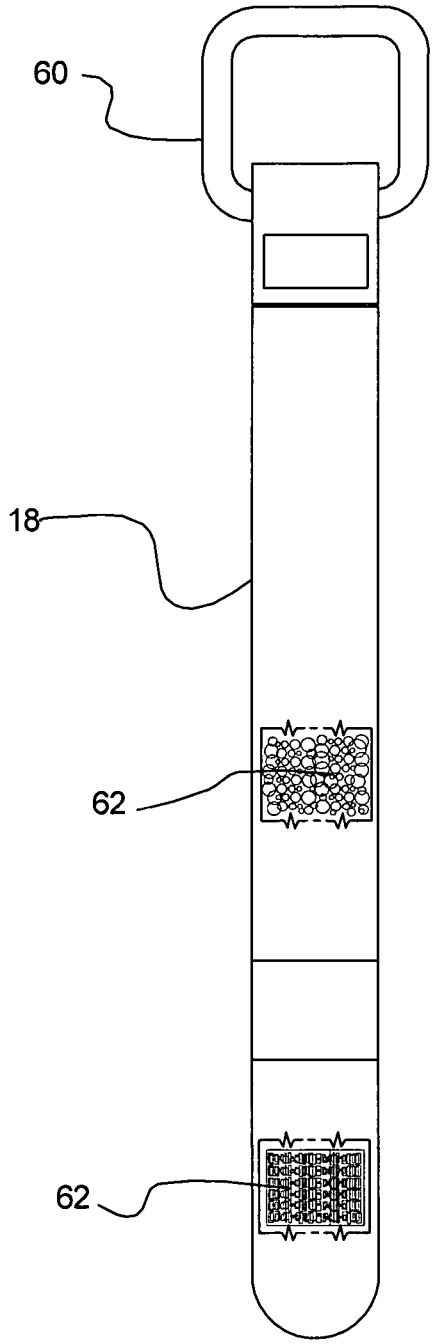
FIG. 7 illustrates a preferred example of a strap for use with the disclosed invention.
Figure 8:
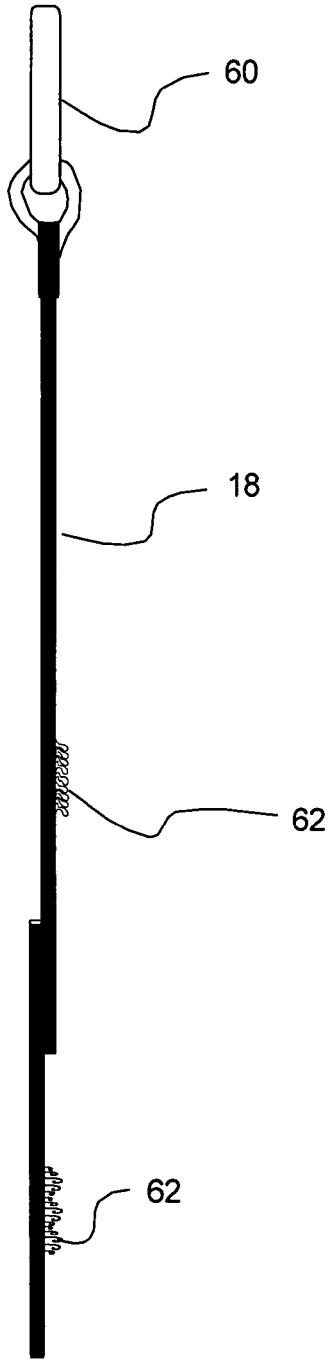
FIG. 8 is a side view of the strap illustrated in FIG. 7.

Referring to FIGS. 1, 7 and 8, it will be understood that the support sleeve 16 will also include a least one loop 60 for the strap 18. This strap 18 will preferably include sections of hook and loop material 62 on surfaces 64, which will allow the strap 18 to be cinched around a support structure and held in place through the cooperation of the hook and loop material. Additionally, the loop 60 may be used with a swivel clip 61, such as the type discussed in U.S. Pat. No. 4,419,794, incorporated herein in it entirety by reference, that will allow the device to be used with a shoulder strap, allowing the oxygen therapy device 10 to be supported generally vertically while carried from a user's shoulder.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An oxygen therapy humidification device for humidifying gas delivered to a patient, the device comprising:

a hollow water reservoir;

an oxygen inlet and an oxygen outlet positioned at the upper end of the hollow water reservoir and providing fluid communication into the hollow water reservoir, the oxygen inlet having a bypass valve that is connected to a duct that extends from the oxygen inlet to a diffuser that is positioned at the lower end of the hollow water reservoir, the bypass valve being a needle type valve that is axially adjustable to allow the user to control humidification by controlling the proportion of oxygen delivered through the bypass valve to the duct and to the diffuser or into the hollow reservoir where it is allowed to remix with oxygen that was delivered to the diffuser, so that the remixed oxygen is then allowed to escape the hollow reservoir through the oxygen outlet.

2. An oxygen therapy humidification device for exposing oxygen to water in a liquid state while the oxygen is being delivered to a patient, the device comprising:

a hollow water reservoir;

a cap that is adapted for attachment to the hollow water reservoir, the cap including an oxygen inlet and an oxygen outlet for providing fluid communication into the hollow water reservoir, the oxygen inlet having a bypass valve that is connected to a duct that extends from the oxygen inlet to a diffuser that is positioned at the lower end of the hollow water reservoir, the bypass valve comprising a needle valve that includes threads that allow axial movement of a needle that adjustably extends into the inlet duct to allow the user to control humidification by controlling the proportion of oxygen delivered to the bypass valve and then delivered to the duct and to the diffuser or into the hollow reservoir where it is allowed to remix with oxygen that was delivered to the diffuser, so that the remixed oxygen is then allowed to escape the hollow reservoir through the oxygen outlet.

3. An oxygen therapy device according to claim 2 wherein said cap further comprises at least one belt loop, and the device further comprising an adjustable strap that is adapted for extending through the belt loop and allowing the support of the device from a support surface.

4. An oxygen therapy oxygen humidification device to be carried by a patient during use, the device comprising:

a hollow water reservoir that includes and an interior and a mouth that provides access to the interior;

a cap that is adapted for sealingly engaging the mouth of the hollow water reservoir, the cap having an oxygen inlet and an oxygen outlet that provide fluid communication into the hollow water reservoir, the oxygen inlet having a bypass valve that is connected to a duct that extends from the oxygen inlet to a diffuser that is positioned at the lower end of the hollow water reservoir, the bypass valve comprising a needle valve that uses a needle that adjustably extends into the inlet duct to allow the user to control the humidification of prescribed oxygen by controlling the proportion of the prescribed oxygen delivered to the bypass valve and then delivered to the duct and to the diffuser or into the hollow reservoir where it is allowed to remix with oxygen that was delivered to the diffuser, so that the remixed oxygen is then allowed to escape the hollow reservoir through the oxygen outlet.

* * * * *